US005201603A

United States Patent [19]

Bassett et al.

[11] Patent Number: 5,201,603

[45] Date of Patent: Apr. 13, 1993

[54] TOW POINT FOR AN ASPHALT PAVER

[75] Inventors: James H. Bassett, Sycamore; Jay A. King, Maple Park; Andrew W. Green; David Emerson, both of Geneva, all of Ill.

[73] Assignee: Caterpillar Paving Products Inc., Minneapolis, Minn.

[21] Appl. No.: 702,067

[22] Filed: May 17, 1991

[51] Int. Cl.[5] ..... E01C 19/00

[52] U.S. Cl. ..... 404/84.1; 404/96; 404/110; 404/114

[58] Field of Search ..... 404/83, 84.1, 84.2, 404/84.05, 84.5, 84.8, 96, 101, 104, 110, 114, 118

[56] References Cited

U.S. PATENT DOCUMENTS

| | | | |
|---|---|---|---|
| 2,441,532 | 5/1948 | Millikin et al. | 404/84.1 |
| 2,473,961 | 6/1949 | Mandt et al. | 404/118 |
| 2,922,345 | 1/1960 | Mentes | 404/84.2 |
| 3,846,035 | 11/1974 | Davin | 404/84.1 |
| 3,873,226 | 3/1975 | Teach | 404/84.5 |
| 3,997,277 | 12/1976 | Swisher et al. | 404/84.05 |
| 4,749,304 | 6/1988 | Craig | 404/101 |

FOREIGN PATENT DOCUMENTS

| | | | |
|---|---|---|---|
| 194918 | 9/1986 | European Pat. Off. | 404/118 |

*Primary Examiner*—Ramon S. Britts
*Assistant Examiner*—Roger J. Schoeppel
*Attorney, Agent, or Firm*—Jones, Day, Reavis & Pogue

[57] ABSTRACT

A tow point for an asphalt paver, which allows the operator to: (1) select either a fixed or sliding tow point connection; and (2) select from among several possible locations of each, thereby adjusting the distance between the screed and transverse auger of the paver. Combination of these features in a single machine makes it possible to lay down an asphalt mat of uniformly desired thickness, while optimizing use of the aggregate batch particles.

12 Claims, 6 Drawing Sheets

TOW POINT FOR AN ASPHALT PAVER

BACKGROUND OF THE INVENTION

The present invention relates generally to asphalt pavers of the floating screed type, and more particularly to the tow point connection used to join the floating screed and tractor portions of such a paver.

"Floating screed" asphalt finishing machines have provided an efficient and economical method of coating an old or new roadway with a compacted layer of asphalt aggregate for many years. Prior to the advent of such machines, the asphalt material was commonly raked by hand to grade and contour a roadway surface with unacceptable results.

Floating screed pavers are generally well known to those skilled in the art, as reflected by the disclosures contained in U.S. Pat. Nos. 3,997,277 issued to Swisher, Jr. et al.; 4,702,642 issued to Musil; 4,749,304 and 4,772,156 both issued to Craig; and 4,948,292 issued to Haven et al. Such a paver typically comprises a self-propelled paving vehicle (i.e., the tractor) having a hopper at its front end for receiving paving material, such as asphalt aggregate, from a dump truck.

A conveyor system on the tractor, in turn, transfers the paving material from the hopper rearwardly for discharge onto the underlying roadbed. Transversely arranged screw augers positioned at the rear end of the tractor assist in moving the paving material in a lateral direction with respect to the direction of movement of the paver, so that a relatively uniform volume of paving material is distributed across the portion of the roadbed in front of the floating screed.

This screed is commonly operated so as to "float" by virtue of being connected to the forwardly moving tractor by means of pivoted leveling arms. The screed, itself, performs two crucial functions. First, it physically levels any paving material lying higher than a predetermined height above the roadway surface, leaving a generally uniform thickness of such material. This function is enhanced by inclining the bottom surface of the screed so that its forward edge is higher than its rear edge, thereby providing a smaller area between the screed and the roadway, and a large dragging surface. The angle defined between the bottom surface of the screed and the roadway surface is called the "angle of attack."

The second function of the screed is to compact the dragged paving material in order to provide a uniform, smooth, durable pavement surface. In order to do this, the screed may actually vibrate against the pavement material.

The "tow point" is the point at which the leveling arms of the screed are attached to the paver tractor. In early pavers this point was a simple fixed pin connection. The thickness of the resulting paved mat, therefore, could only be controlled by means of altering the screed angle of attack.

Eventually, an additional feature was added to paver designs in order to allow the tow point to be moved vertically, causing a corresponding movement in the leveling arms and screed. This accommodated changes in the grade of the road surface by automatically fine tuning the initial setting of the screed angle of attack, thereby controlling the pavement mat thickness.

Two important aspects of paver operation are affected by the tow point connection between the tractor and screed units. First, it is generally preferred to add asphalt to the paver while the paver is still moving in order to avoid joints or dips and valleys in the resulting asphalt mat caused by stopping and starting movement of the machine. Thus, dump trucks full of the asphalt material are usually positioned ahead of, and in the path of, the paver. As the paver approaches the truck, or as the truck is backed towards the paver, push rollers on the front of the paver engage or are engaged by the dump truck's rearmost tires. At the moment of impact between the truck and paver, the paver is usually urged backwards, particularly if the truck has been backed into it. If the screed leveling arm is rigidly connected to the tractor, then the screed will likewise be moved backwards, which can damage the surface of the newly laid asphalt mat, causing bumps and valleys. Therefore, it would be advantageous to provide a paver which permits some degree of relative motion between the tractor and screed leveling arm connection so that the screed is not moved backwards when the paver and truck impact.

Second, the distance between the screed and the transverse auger of the tractor determines the size of aggregate particles which can pass between these two points. Therefore, the distance is usually adjusted to reflect the largest aggregate particle size being laid. In many asphalt mixes, especially those with high percentages of recycled asphalt, it is desirable to minimize the gap between the transverse auger and the front plate of the screed to minimize the buildup of hardened "dead" material, thereby reducing tearing of the asphalt mat and improving the quality of the end product. This gap is adjusted most easily at the tow point.

SUMMARY OF THE INVENTION

Accordingly, it is an object of the present invention to provide an asphalt paver which allows adjustment of the distance between the transverse auger and floating screed therein by means of the tow point.

Another object of the present invention is to provide the option of selecting a fixed tow point connection between the screed leveling arm and the paver tractor.

Still another object of the present invention is to provide a machine with a sliding tow point connection between the screed leveling arm and the paver tractor.

Yet another object of the present invention is to provide a means by which the operator can select different lengths of sliding connection between the screed leveling arm and the paver tractor depending upon conditions and maximum clearance between the screed and the transverse auger.

Briefly, the invention is directed to providing a tow point for an asphalt paver, which allows the operator to:

(1) select either a fixed or sliding tow point connection; and (2) select from among several possible locations of each, thereby adjusting the distance between the screed and transverse auger.

By combining all of these features in a single paver tow point design, it is possible to lay down a higher quality asphalt mat.

BRIEF DESCRIPTION OF THE PREFERRED EMBODIMENT

Figure 1:
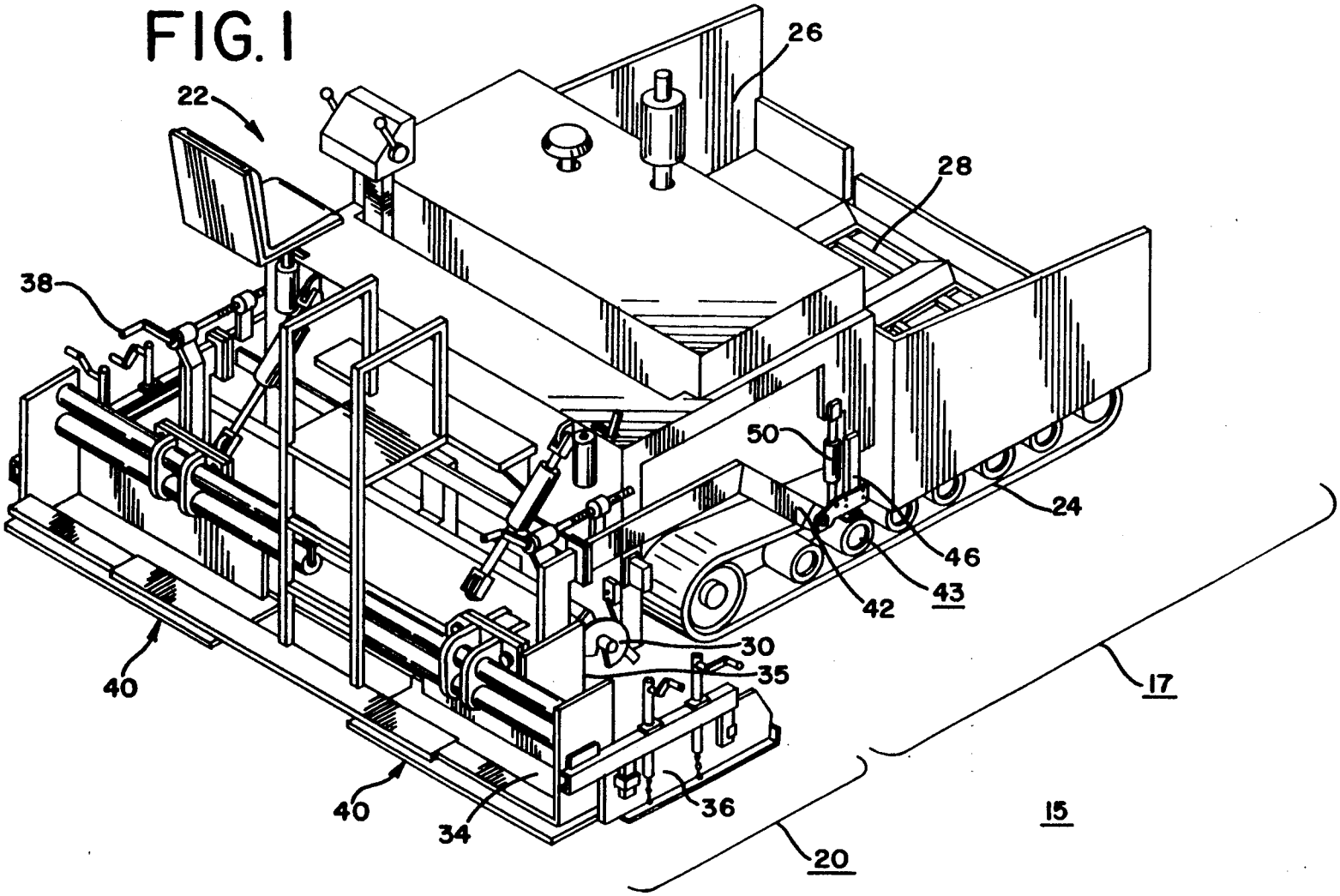
FIG. 1 is a perspective view of the overall paver machine.

The asphalt paver tow point of the present invention may be more readily understood by reference to the accompanying drawings. FIG. 1 shows a perspective view of the overall asphalt paver 15, having a traction unit, such as tractor 17, and vibratory screed 20, which is of the floating type. Tractor 17 provides the motive force for the paver machine, having an engine (not shown), operator station 22, and rubber crawler tracks 24, although the tractor could run as easily on rubber tires.

At the front of the tractor is located hopper 26 into which is transferred the paving material, such as asphalt mix. The tractor also includes a conventional conveyor system, consisting of longitudinally disposed conveyors 28, which are used to transport the asphalt to the rear of the machine. Positioned at the rear end of tractor 17 are transverse screw augers 30, which spread the asphalt material out laterally on roadway surface 32 in front of screed 20.

Screed 20 has sole plate 34, front plate 35, and end gate 36, which are used to contain and level the deposited asphalt material on the roadway. Thickness control 38 may be used by the operator to adjust the angle of inclination (i.e., "angle of attack") of screed sole plate 34, as already discussed above, in order to adjust the thickness of the resulting asphalt mat 54. The thickness control uses rod and bearing means. Screed 20 is of the vibratory type generally known to those of ordinary skill in the art, and acts to compact and level the asphalt layer into a finished asphalt mat.

Screed 20 is pivotably connected to tractor 17 by means of extension arm 42. The tow point connection 43 may be seen more easily in FIG. 2. Extension arm 42 is pivotably connected to tow point plate 44, which, in turn, is slideably connected to post 46 by means of cam bearings 47. Post 46 is fastened to the side of tractor 17. Extending rearwardly from the upper portion of post 46, co-planar with tow point plate 44, is flange 48. Flange 48 and tow point plate 44, in turn are connected by means of hydraulic cylinder 50. Grade sensors connected to the power machine (not shown) may send electrical signals to a hydraulic valve (not shown) on the tractor which thereby causes hydraulic cylinder 50 to retract or extend, and in so doing raising or lowering tow point plate 44, and with it extension arm 42 and screed 20. In this way, the distance between screed sole plate 34 and roadway surface 32 may be automatically fine tuned to reflect changes in the grade of the roadway. It should be understood that the preceding elements have been discussed in the singular, but identical elements coexist on the other side of the paver machine 15.

Figure 2:
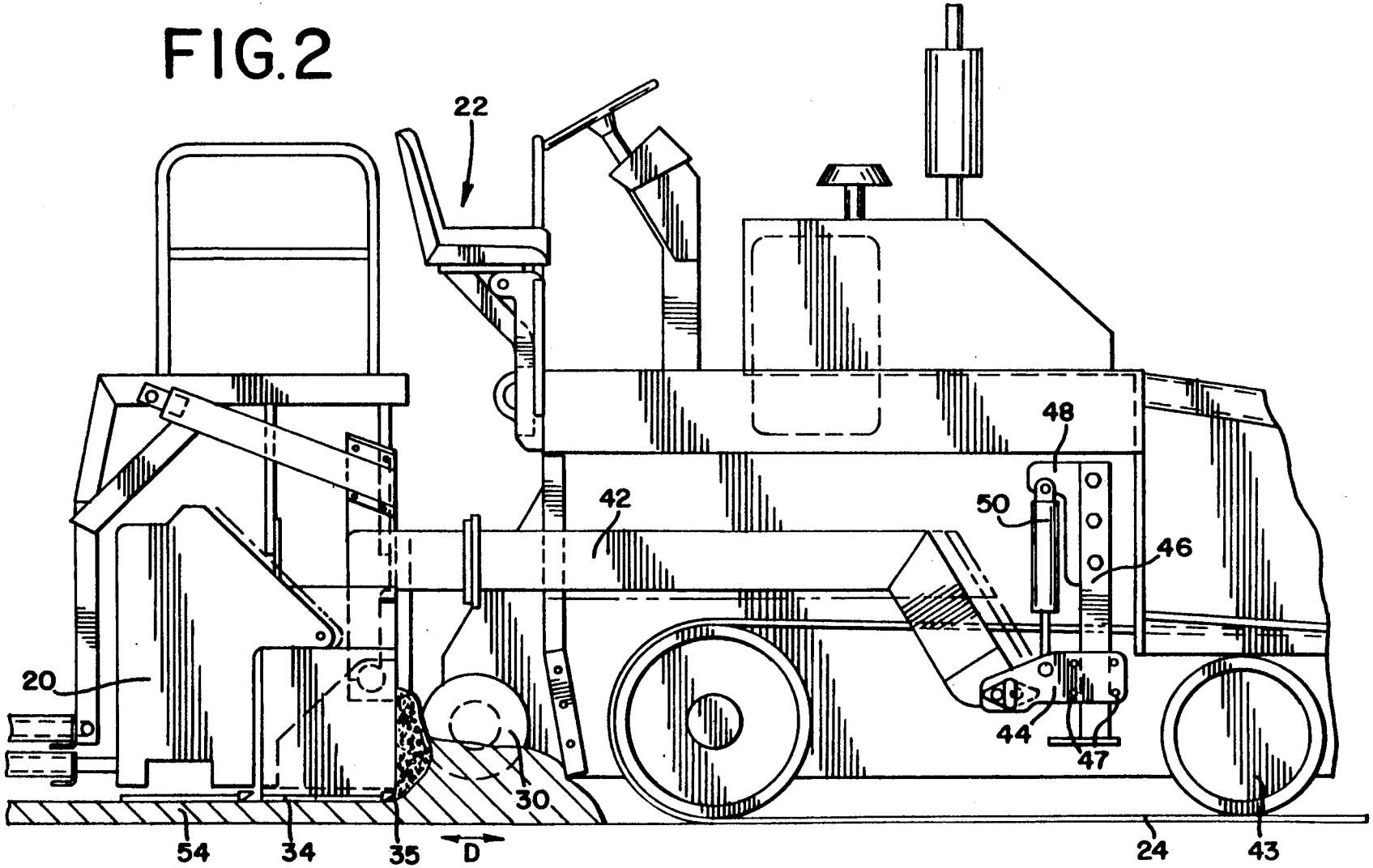
FIG. 2 is a partial plan view of the right side of the paver machine shown in FIG. 1.

FIG. 2 also shows the distance D between the front plate 35 of screed 20 and transverse screw augers 30. The paver of the present invention permits distance D to be changed by suitable adjustment to the tow point.

Figure 3:
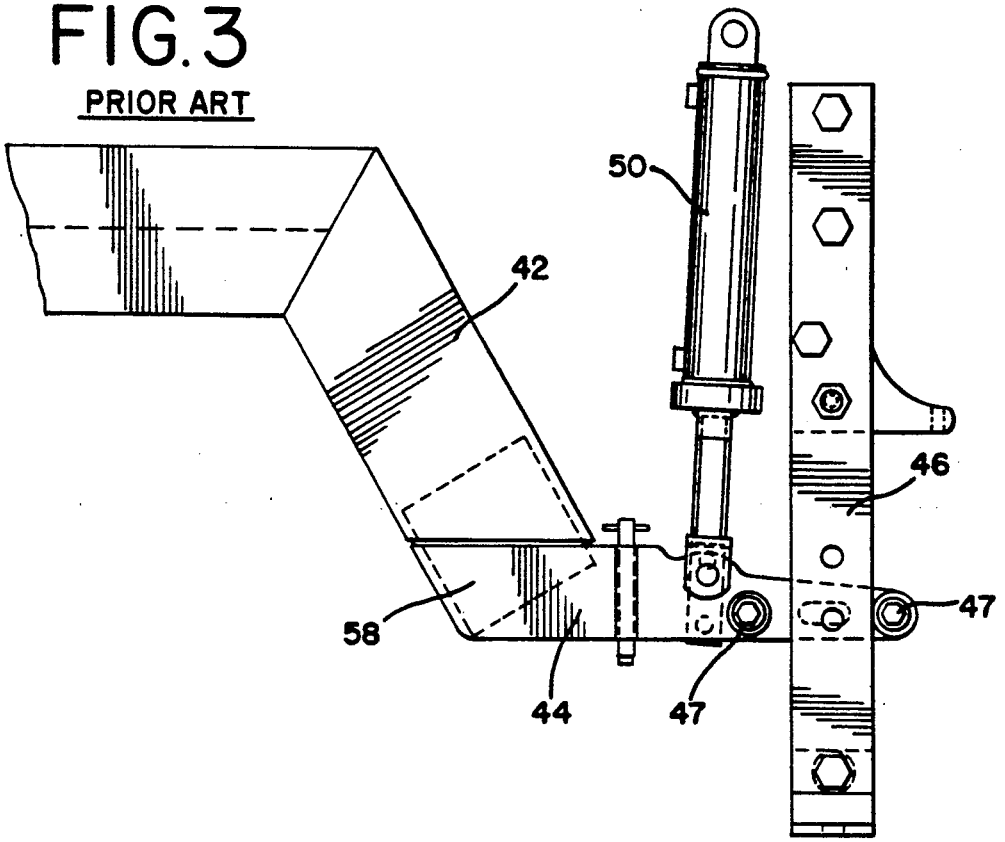
FIG. 3 PRIOR ART
FIG. 3 illustrates one prior art embodiment of a tow point.

FIG. 3 shows a prior art form of tow point connection, such as used in Blaw-Knoxp3 s BK-450 Tracked Paver or Barber-Greene Company's B-G 200 Series Asphalt Paver. Matching like elements with like numbers, tow point plate 44 is moved vertically with respect to tractor post 46 by means of hydraulic cylinder 50. Tow point plate 44, in turn, is joined to leveling arm 42 by means a solid weld 58. The tow point is joined to post 46 by means of cam follower bearings 47. Some open space may be provided between these elements, thereby permitting relative fore/aft motion between tractor post 46 and tow point plate 44, forming a pseudo "slot." However, it is not possible to fix this tow point location in a particular fore and aft location, nor is it possible to adjust the gap D between the screed 20 and transverse auger 30 without completely pinning the connection joint and/or losing all vertical control by hydraulic cylinder 50.

Figure 4:
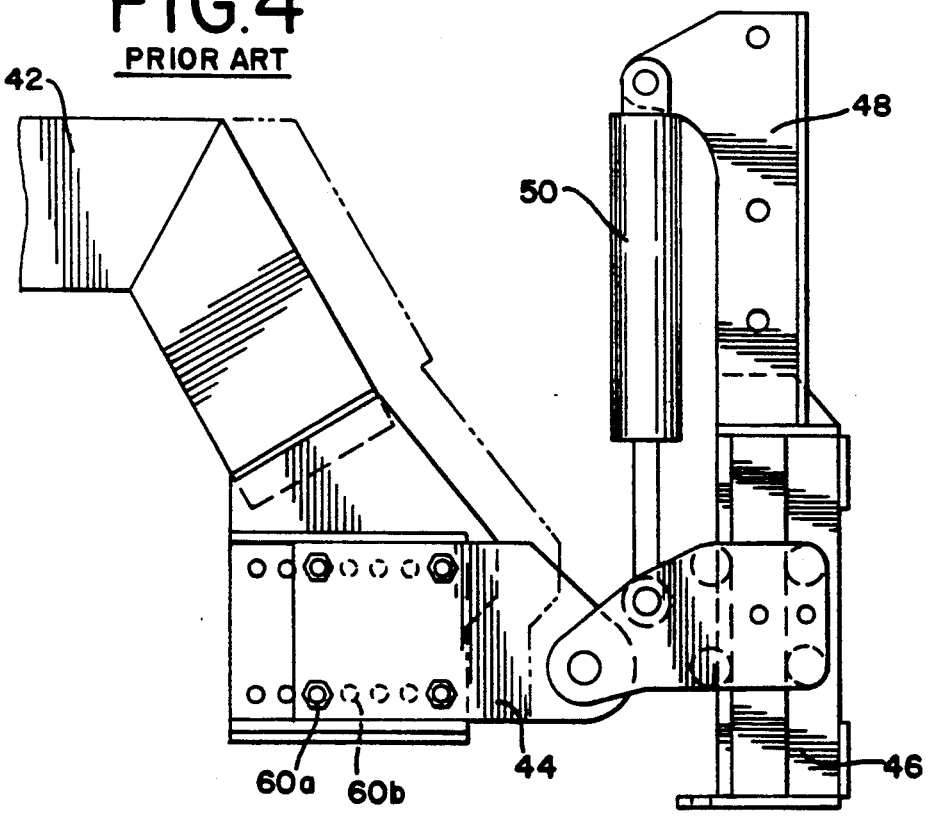
FIG. 4 PRIOR ART
FIG. 4 shows a second prior art embodiment of a tow point.
Figure 5:
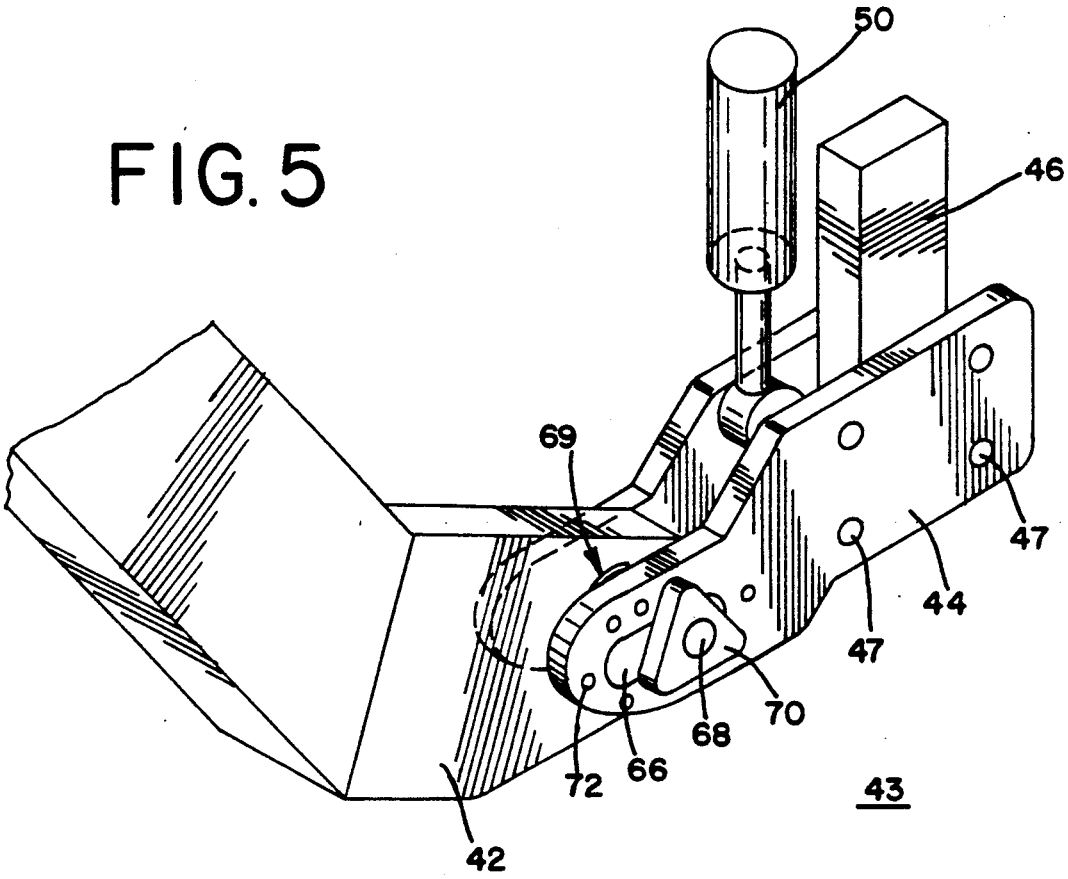
FIG. 5 discloses a perspective view of the tow point of the present invention.

FIG. 4 shows a modified tow point incorporated in Blaw-Knox's PF-150 paver or Cedarapids' CR 351 finisher. Here, the screed leveling arm 42 and tow point plate 44 have a series of mating holes 60*a*, 60*b*, etc., and are joined by means of a pin 68. This type of tow point provides fore/aft adjustment of the gap D between the screed and transverse auger, but does not allow for relative motion between the paver tractor and screed, nor does it permit selection of different ranges for that motion.

Figure 6:
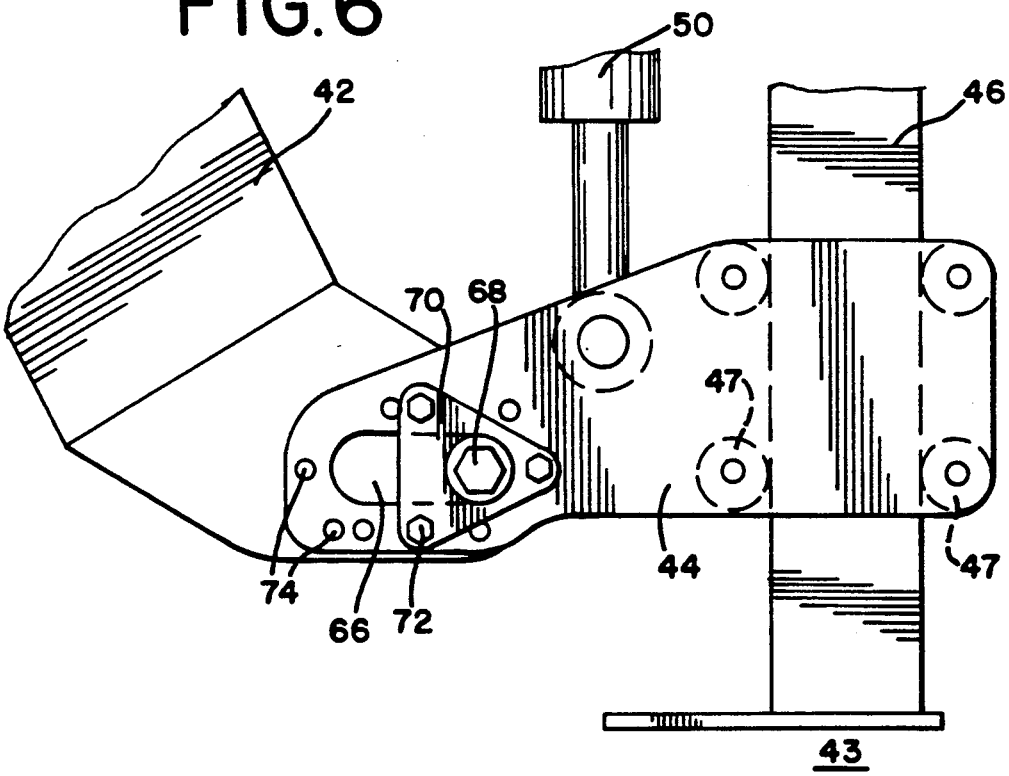
FIG. 6 is a plan view of a fixed tow point of the present invention shown in FIG. 5 in its full forward position.
Figure 7:
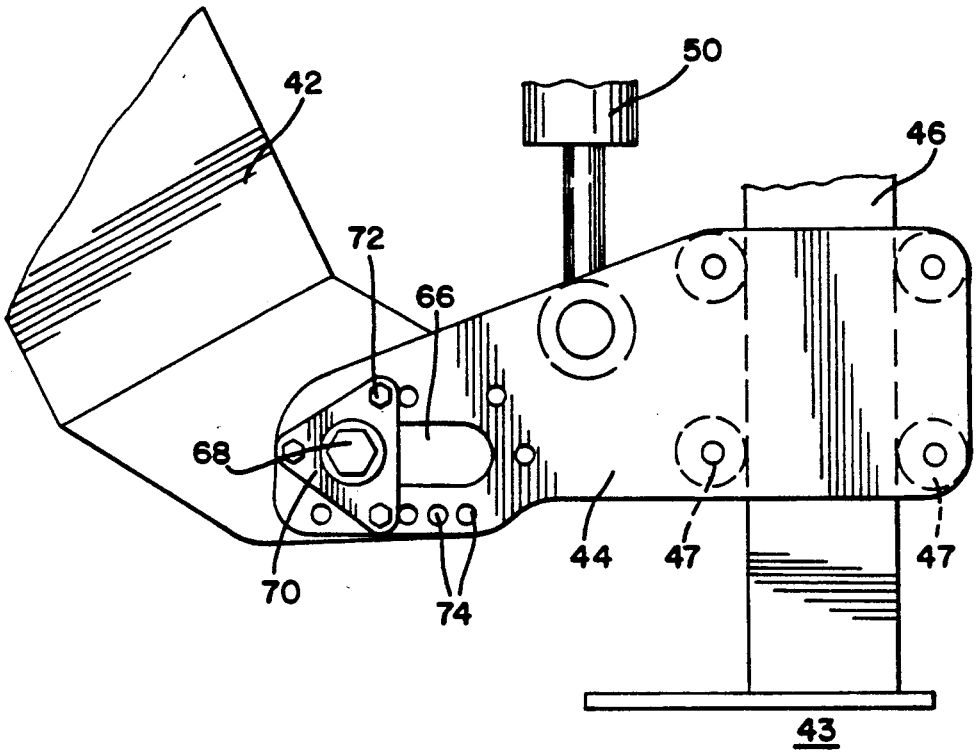
FIG. 7 is the same as FIG. 6 except that the fixed tow point is in the full back position.

FIGS. 5–9 illustrate the first embodiment of the present invention. Here, leveling arm 42 has a hole 62 at its forward end into which is located spherical bushing 69, while tow point plate 44 bears a longitudinal slot 66 in its rear end. Instead of using a simple pin 68, however, to join the leveling arm and tow point plate, the pin is inserted through an intermediate locking plate 70 in addition to the two aforementioned orifices. Locking plate 70 bears a number of holes 72 which mate with a series of corresponding holes 74 in tow point plate 44. By affixing locking plate 70 and tow point plate 44 together by means of bolts, plugs, pins, etc., leveling arm 42 may be pivotably engaged to tow point plate 44 with the cylindrical shaft of pin 68. Moreover, spherical bushing 69 provides rotation means around a fore/aft and a transverse axis between the leveling arm and tow point plate without permitting fore/aft movement between these parts. Instead, the series of horizontally arranged holes 74 in tow point plate 44 permit locking plate 70 to be fastened in a number of positions along the rearward length of the tow point plate and therefore adjusted in the fore/aft direction. Thus, the leveling arm may be locked in a forward position with respect to the tow point plate (with screed 20 closer to auger 30), as shown in FIG. 6, or a rearward position (with the screed further away from the auger, as illustrated in FIG. 7). While locking plate 70 is shown as a triangle in these drawings, a number of different geometrical shapes are possible, provided there a sufficient connection between the locking and tow plates, preferably at least three. The relative locations and interworkings of the various tow point parts may be seen more readily in FIG. 9, including spherical bushing 69.

Figure 8:
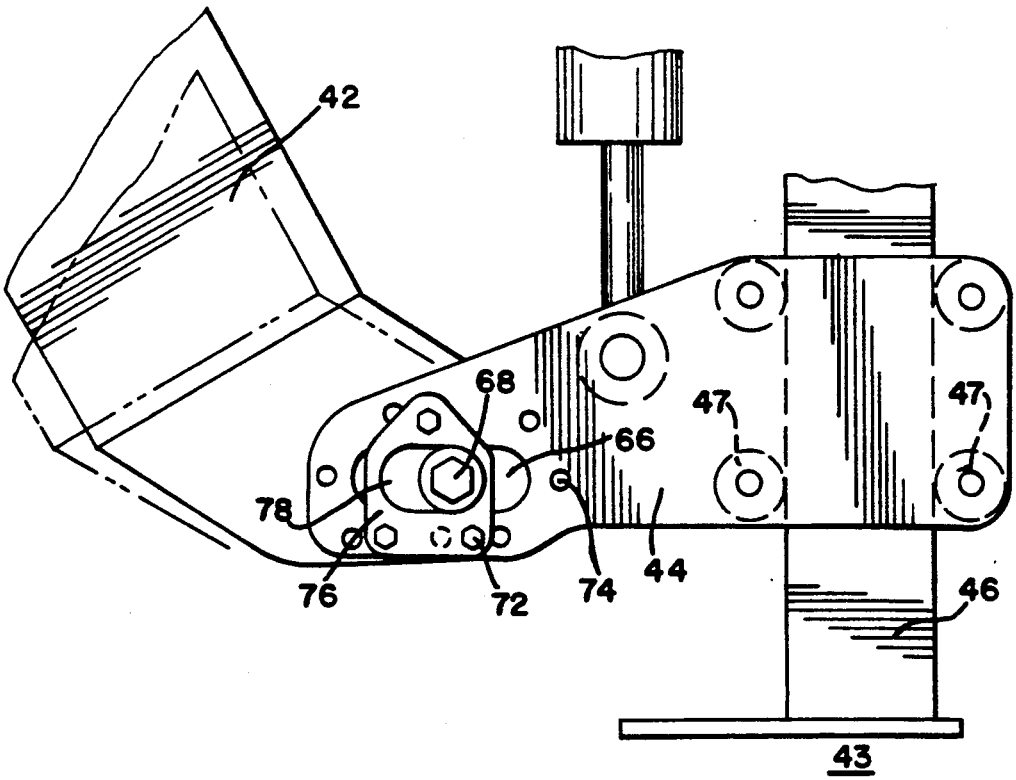
FIG. 8 shows the same tow point assembly fitted for a slotted connection.
Figure 9:
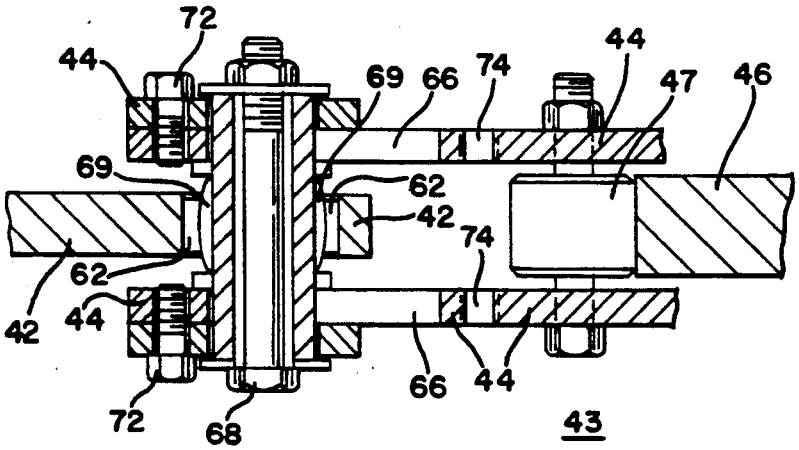
FIG. 9 is a section taken along the line 9—9 of FIG. 7.

FIG. 8 shows a similar type of tow point arrangement, except that locking plate 76 now is used, bearing a longitudinal slot 78. Pin 68 now may move longitudinally in both locking and tow point plates so that movement in tow point plate 44 will not necessarily impart similar movement in leveling arm 42. At the same time, provision has been made for In this manner, the present invention provides a single leveling arm and tow point plate assembly for an asphalt paver machine, which allows the operator to preselect a fixed or slotted tow point between the two parts, move the slot range or fixed tow point location fore or aft to adjust the clearance between the screed and the transverse screw auger to whatever distance is preferred, and select different slot lengths based upon conditions and maximum clearance between the screed and transverse auger. The ability to provide this variety of operating conditions in a single machine is a major advantage over the tow points embodied in the prior art, reducing cost and need to change machines at the job site.

Figure 10:
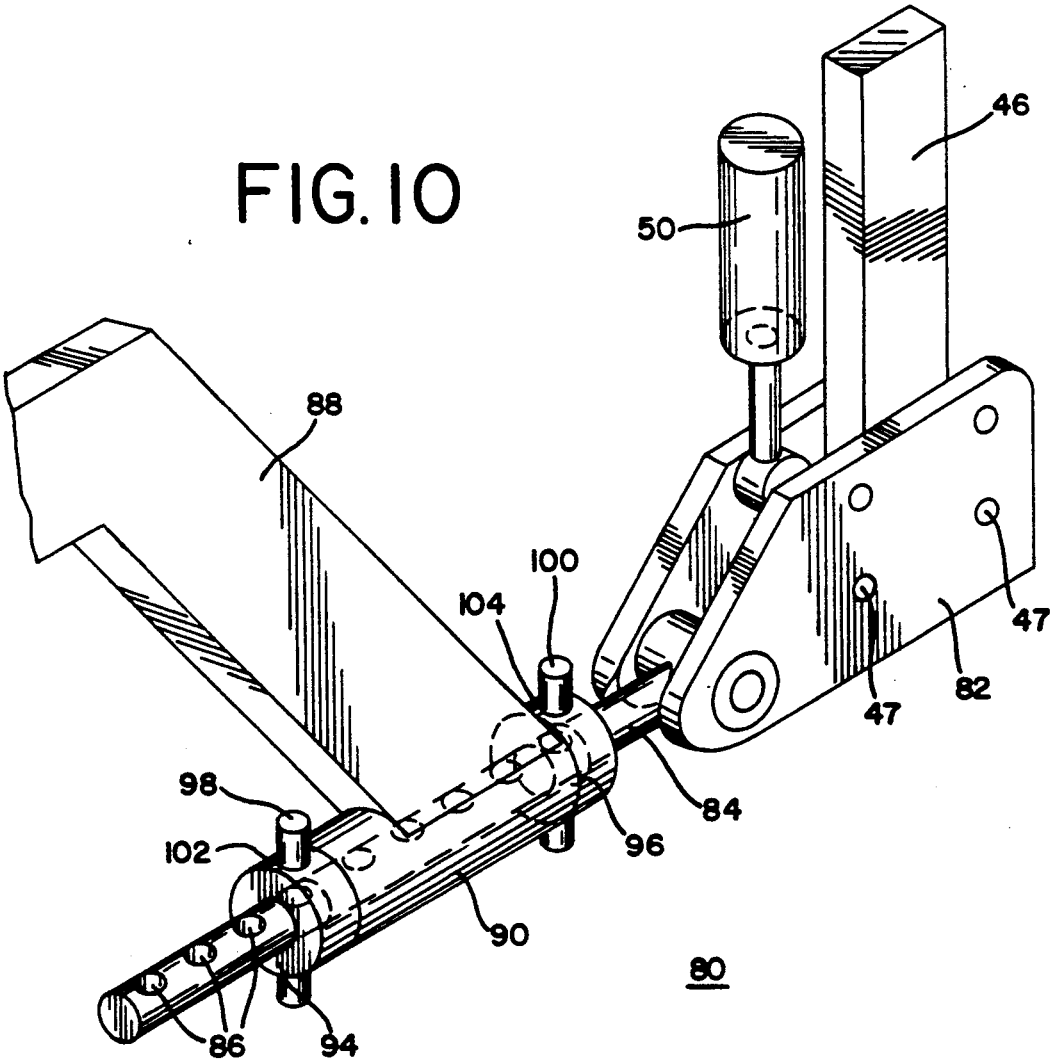
FIG. 10 is a perspective view of another embodiment of the tow point of the present invention.

An alternate embodiment of the invention is illustrated in FIG. 10, generally designated as tow point 80. While tow point plate 44 directly engages leveling arm 42 in the tow point embodiments shown in FIGS. 5–9, tow point plate 82 in this second embodiment is pivotably connected along its rear end to shaft 84. The shaft, in turn, bears a plurality of holes 86 along its length. Screed leveling arm 88 has attached to its forward end an annular cylinder sleeve 90 having an internal bore 92. The leveling arm sleeve and tow point plate shaft are arranged so that the shaft is inserted through the sleeve bore, and the sleeve may slideably engage the shaft. Finally, annular collars 94 and 96 are positioned along shaft 84 at forward and rearward positions, respectively, with respect to sleeve 90. Pins 98 and 100 are inserted through bores 102 and 104 in collars 94 and 96, respectively, and any two bores 86 in shaft 84 in order to rigidly retain the collars in their positions along the tow point shaft. In this manner, collars 94 and 96 serve to contain the longitudinal movement of leveling arm sleeve 88 along tow point plate shaft 84. In this embodiment, the internal bore 92 of sleeve 90 serve as the forward end bearing aperture means of leveling arm 88, while shaft 84 serves as the rear end bearing aperture means. By preselecting through which bores 86 the operator inserts collar retaining pins 98 and 100, sleeve 90 providing tow point 80 may be moved fore or aft to adjust the clearance D between the screed and the auger in order to optimize use of a particular batch of asphalt mix. At the same time, holes 86 may be selected which will cause collars 94 and 96 to tightly engage leveling arm sleeve 90, thereby creating a "fixed" tow point arrangement, or holes 86 may be selected, which will leave room between the collars and respective ends of the sleeve, effectively producing a "slotted" tow point. Naturally, the operator may also select different "slot lengths" through use of appropriate shaft bores 86.

Whether a paver featuring the tow point embodied in FIGS. 5–9 or FIG. 10 is chosen, the end result is the same: it is possible to obtain the benefits of a fixed or slotted tow point, choose the length of the slotted tow point, and optimize the gap distance between the transverse feed augers 30 and floating screed 20 by means of either type of tow point in a single machine.

While particular embodiments of the invention have been shown and described, it should be understood that the invention is not limited thereto, since many modifications may be made. The invention, therefore, is contemplated to cover by the present application any and all such modifications which fall within the true spirit and scope of the basic underlying principles disclosed and claimed herein.

What is claimed is:

1. A tow point assembly for a finishing paver having a traction unit for providing motive force, a screw auger for laterally distributing paving material onto a roadbed, and a floating screed for leveling and compressing the paving material into a compacted mat, the tow point assembly, comprising:

(a) a leveling arm extending forward from the floating screed and having a forward end bearing aperture means; a row point plate connected to the traction unit and having a rear end bearing aperture means which slideably engages the forward end of said leveling arm; and (c) fastening means for connecting the forward end of said leveling arm and the rear end of said tow point plate together in a manner such that they may be adjusted into either fixed or sliding connection, and they may be horizontally adjustably engaged prior to such connection so that a selectively variable horizontal distance between the floating screed and the auger is obtained.

2. A tow point assembly as recited in claim 1, wherein said fastening means comprises a pin means inserted through the aperture means of said leveling arm and said tow point plate, as well as an aperture means in a locking plate prepositioned over the aperture means of said tow point plate.

3. A tow point assembly as recited in claim 1, wherein the aperture means of said leveling arm comprises a bore of generally the same cross-sectional area as the cross-sectional area of the pin means.

4. A tow point assembly as recited in claim 1, wherein the aperture means of said tow point plate comprises a horizontally oriented slot having a longitudinal cross-sectional dimension longer than the corresponding cross-sectional dimension of the pin means.

5. A tow point assembly as recited in claim 2, wherein the aperture means of the locking plate comprises a bore of generally the same cross-sectional area as the cross-sectional area of the pin means.

6. A tow point assembly as recited in claim 2, wherein the aperture means of the locking plate comprises a horizontally oriented slot having a longitudinal cross-sectional dimension longer than the corresponding cross-sectional dimension of the pin means.

7. A tow point assembly as recited in claim 2, further comprising a plurality of mating holes in said locking plate and said tow point plate in a manner such that said locking plate may be fastenably connected to the side of said tow point plate at a plurality of different positions over the aperture means of said tow point plate.

8. A tow point assembly for a finishing paver having a traction unit for providing motive force, a screw auger for laterally distributing paving material onto a roadbed, and a floating screed for levelling and compressing the paving material into a layered mat, the tow point assembly, comprising:

(a) a leveling arm extending forward from the floating screed, and having attached to a forward end thereof sleeve means;

(b) a tow point plate connected to the traction unit, and having pivotably connected to its rear end thereof a shaft having a plurality of apertures therein, said shaft slideably engaging said sleeve means; and (c) containing means for restricting movement of said sleeve means along said shaft in a manner such that they may be adjusted into either fixed or sliding connection and they may be horizontally adjustably engaged prior to such connection so that a selectively variable horizontal distance between the floating screed and the auger is obtained.

9. A tow point assembly as recited in claim 8, wherein said sleeve means comprises an annular block having a longitudinal bore of generally the same cross-sectional area as the cross-sectional area of said shaft.

10. A tow point assembly as recited in claim 8, wherein said containing means comprises collar means positioned along both ends of said sleeve means, and engaging said shaft.

11. A tow point assembly as recited in claim 10, wherein said collar means comprises an annular block slideably engaging said shaft, and having a bore through which pinning means engages an aperture in said shaft.

12. A tow point assembly as recited in claims 1 or 8, further comprising means for selective vertical adjustment of said tow point plate with respect to the traction unit to selectively adjust an angle of attack between the screed and the roadbed by means of said leveling arm pivotably connected at its one end to the screed, ad at its second end to said tow point plate.

* * * * *